US011028685B2

(12) United States Patent
Taylor et al.

(10) Patent No.: US 11,028,685 B2
(45) Date of Patent: Jun. 8, 2021

(54) DOWNHOLE RATE OF PENETRATION MEASUREMENT

(71) Applicant: Novatek IP, LLC, Provo, UT (US)

(72) Inventors: Malcolm Taylor, Gloucester (GB); Scott R. Woolston, Spanish Fork, UT (US); Jonathan D. Marshall, Mapleton, UT (US); David Hoyle, Salt Lake City, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 124 days.

(21) Appl. No.: 16/025,956

(22) Filed: Jul. 2, 2018

(65) Prior Publication Data

US 2020/0003043 A1 Jan. 2, 2020

(51) Int. Cl.

| | |
|---|---|
| ***E21B 45/00*** | (2006.01) |
| ***E21B 47/024*** | (2006.01) |
| ***E21B 10/42*** | (2006.01) |
| ***E21B 7/04*** | (2006.01) |
| ***E21B 47/09*** | (2012.01) |

(52) U.S. Cl.

CPC ..... *E21B 45/00* (2013.01); *E21B 7/04* (2013.01); *E21B 10/42* (2013.01); *E21B 47/024* (2013.01); *E21B 47/09* (2013.01)

(58) Field of Classification Search

CPC ..... E21B 10/00; E21B 10/26; E21B 45/00; E21B 47/024; E21B 47/09

See application file for complete search history.

(56) References Cited

U.S. PATENT DOCUMENTS

| | | | | |
|---|---|---|---|---|
| 5,585,726 | A | 12/1996 | Chau | |
| 6,564,883 | B2 | 5/2003 | Fredericks et al. | |
| 6,769,497 | B2 | 8/2004 | Dubinsky et al. | |
| 7,058,512 | B2 | 6/2006 | Downton | |
| 7,207,215 | B2 | 4/2007 | Spross et al. | |
| 7,946,357 | B2 * | 5/2011 | Trinh ..... | E21B 45/00 175/40 |
| 8,215,384 | B2 | 7/2012 | Trinh et al. | |
| 8,757,291 | B2 | 6/2014 | Kumar et al. | |
| 9,027,670 | B2 | 5/2015 | Sugiura | |
| 9,238,958 | B2 | 1/2016 | Teodorescu | |
| 9,970,285 | B2 | 5/2018 | Sugiura | |

OTHER PUBLICATIONS

T. Richard, E. Detournay, M. Fear, B. Miller, R. Clayton and O. Matthews; Influence of Bit-Rock Interaction on Stick-Slip Vibrations of PDC Bits, SPE 77616, Copyright 2002 Society of Petroleum Engineers Inc.

A. Leseultre, E. Lamine and A. Jonsson; An Instrumented Bit: A Necessary Step to the Intelligent BHA, IADC/SPE 39341, Copyright 1998 IADC/SPE Drilling Conference.

* cited by examiner

*Primary Examiner* — Tara Schimpf

(57) ABSTRACT

A method for determining a rate of penetration of a drill bit during an earth drilling operation may comprise first urging an element to extend out from a working face of the drill bit. As drilling progresses, this extended element may then be forced back into the drill bit by an internal surface of a borehole being formed. A rate at which the element retracts back into the working face may be measured to aid in estimating a rate of penetration of the drill bit into the earth.

19 Claims, 5 Drawing Sheets

DOWNHOLE RATE OF PENETRATION MEASUREMENT

BACKGROUND

When exploring for or extracting subterranean resources, such as oil, gas, or geothermal energy, and in similar endeavors, it is common to form boreholes in the earth. Such boreholes may be formed by engaging the earth with a rotating drill bit capable of degrading tough subterranean formations. As a borehole is formed and elongated, the drill bit may be fed into it on the end of a series of pipes known as a drill string.

The rate at which a drill bit is able to penetrate a subterranean formation may vary for a number of reasons; such as the composition of the formation, the condition of the drill bit, torque or weight supplied to the drill bit or other factors. An accurate measurement of this penetration rate may provide information regarding these factors. Knowledge of the penetration rate may also aid in calculations of additional drilling parameters such as borehole depth and curvature.

The speed at which a drill string is dispensed into a borehole may give a rough approximation of the drill bit's rate of penetration. However, as the borehole elongates, this surface approximation may become less accurate due to changes in drill string tension based on varying load, friction, or weight-on-bit. Additionally, a variety of downhole tools (e.g. for steering or data logging) may need downhole penetration rate data either sooner, or in greater quantity, than is available from the surface.

For these and other reasons, a simple and reliable method of determining rate of penetration of a drilling operation downhole, near the drill bit, may prove valuable.

BRIEF DESCRIPTION

A method for determining a rate of penetration of a drill bit during an earth drilling operation may comprise first urging an element to extend out from a working face of the drill bit. As drilling progresses, this extended element may then be forced back into the drill bit by an internal surface of a borehole being formed. A rate at which the element is forced back into the working face may be measured to aid in estimating a rate of penetration of the drill bit into the earth.

The steps just described may be repeated, alternating between urging and measuring, such that the rate of penetration may be continually calculated in real time and close to the drill bit. To determine this rate of penetration continuously, a slope of the rate of retraction may be projected onto the time spent extending the element; with adjustments for changes to the rate due to extension forces.

Some known tools already extend elements from drill bit working surfaces. This may be, for example, to aid in steering, reduce occurrences of stick slip or motor stall, or crush earthen formations to accelerate drilling. Adding penetration rate measurement capabilities to such preexisting tools may, thus, be straightforward in many cases.

DRAWINGS

FIGS. 3-1 through 3-3 are orthogonal views of embodiments of an element extending from a working face of a drill bit and making contact with an internal surface of a borehole.

FIGS. 4-1 through 4-5 are charts representing embodiments of methods for determining a rate of penetration of a downhole drilling operation.

FIG. 5 is an orthogonal view of an embodiment of a drill bit forming a borehole comprising a certain radius of curvature.

DETAILED DESCRIPTION

Figure 1:
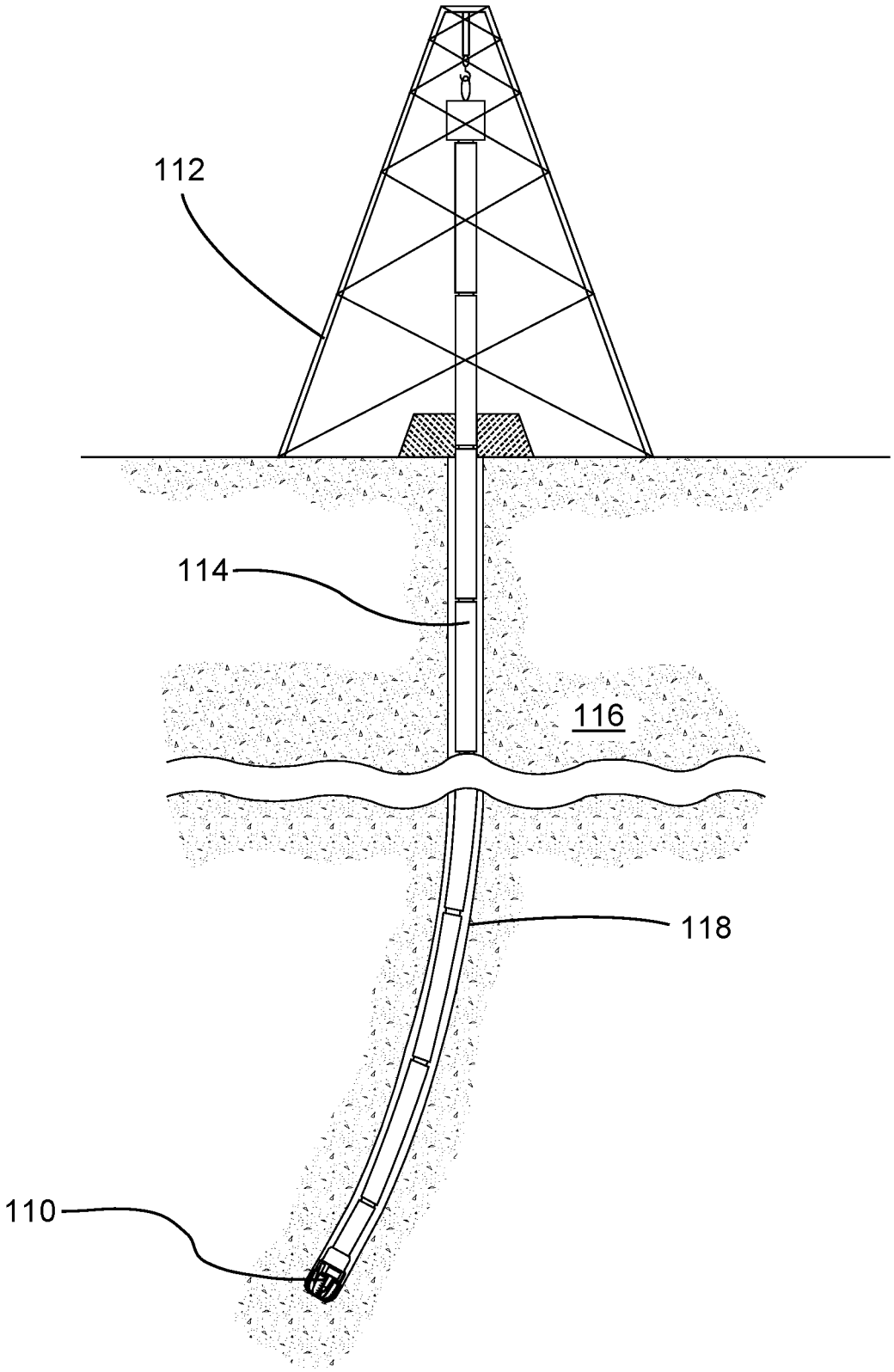
FIG. 1 is an orthogonal view of an embodiment of a drilling operation comprising a drill bit secured to an end of a drill string and forming a borehole through the earth.

Referring now to the figures, FIG. 1 shows an embodiment of a subterranean drilling operation comprising a drill bit 110 suspended from a derrick 112 by a drill string 114. While a land-based derrick is shown, water-based structures are also common. The drill string 114 shown is formed from a plurality of drill pipe sections fastened together end-to-end; however, in other embodiments, flexible tubing may be used. As the drill bit 110 is rotated, either at the derrick 112 or by a downhole motor, it may engage and degrade a subterranean formation 116 to form a borehole 118 therethrough.

Figure 2:
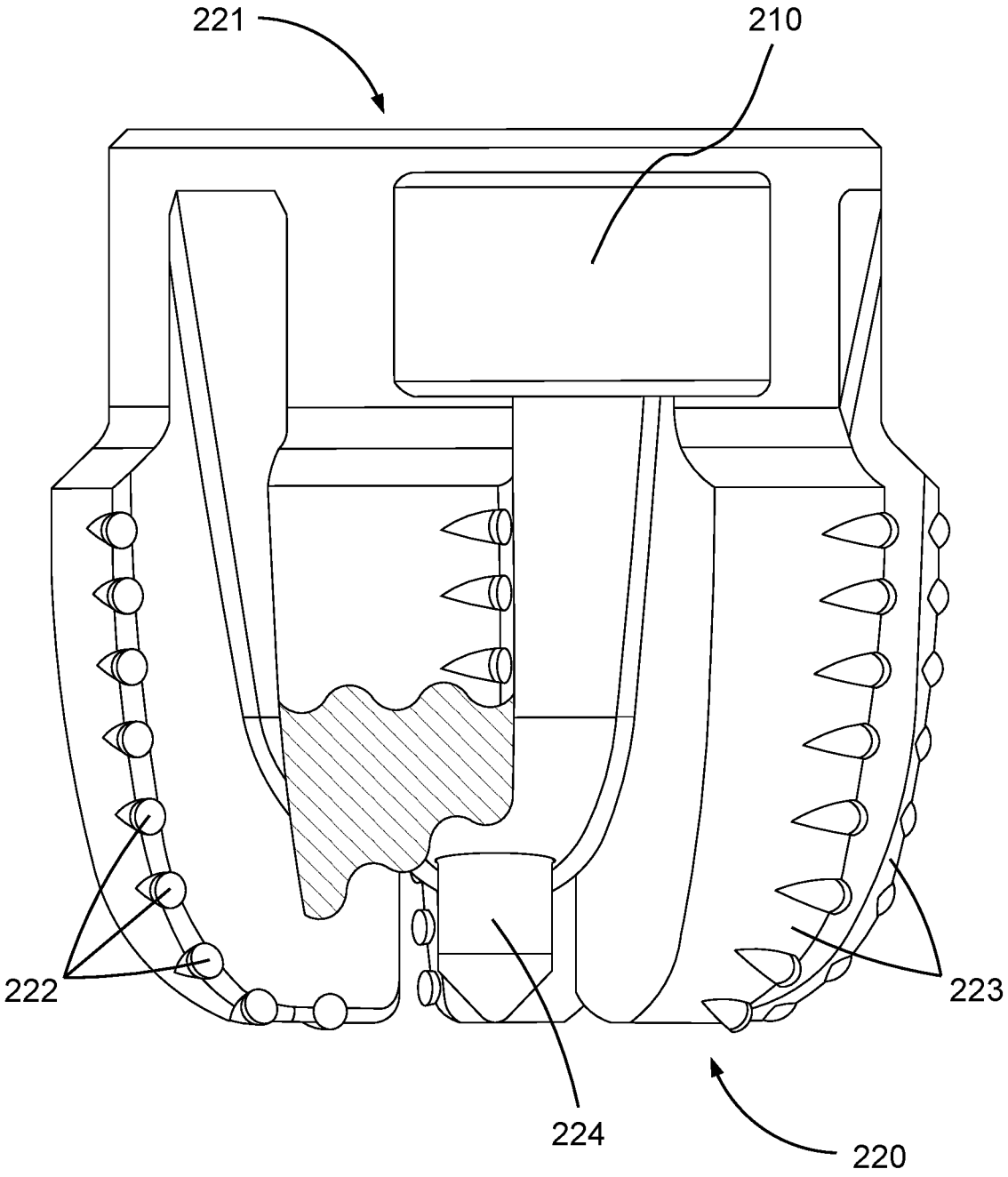
FIG. 2 is a partially-cutaway orthogonal view of an embodiment of a drill bit comprising an element protruding from a working face thereof.

FIG. 2 shows an embodiment of a drill bit 210 comprising a working face 220, on one end, opposite an attachment end 221, on another. The attachment end 221 may comprise a set of internal threads (hidden) capable of attachment to a drill string while the working face 220 may comprise a plurality of cutting elements 222 secured to a series of blades 223. (A drill bit comprising a series of blades may be referred to in the art as a drag bit. Other types of drill bits, such as roller cone bits, may also suffice.) One of the blades 223 has been partially cutaway to reveal an element 224 protruding from the working face 220. This element 224 may protrude from the working face 220 at a rotational axis of the drill bit 210 and comprise an axially symmetrical geometry on an exposed end thereof. It is believed that this axial positioning and symmetrical geometry may allow the drill bit 210 to rotate without significant rotational resistance from the element 224. To further decrease rotational resistance, the element 224 may be free to rotate relative to the working face 220 around the rotational axis of the drill bit 210.

Figures 1, 3:
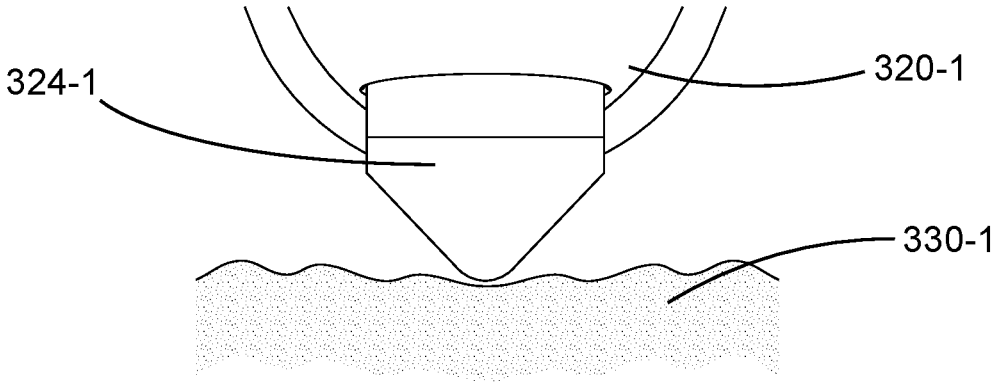
Figures 2, 3:
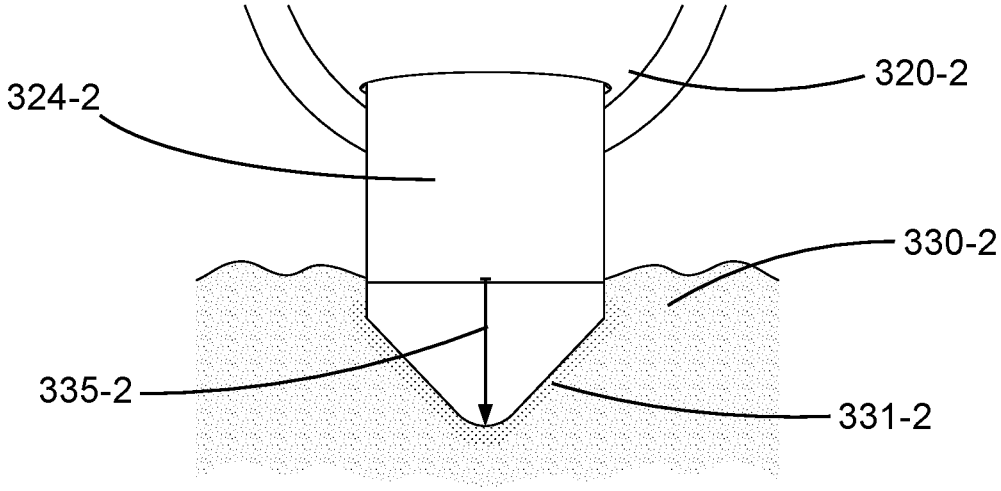
Figure 3:
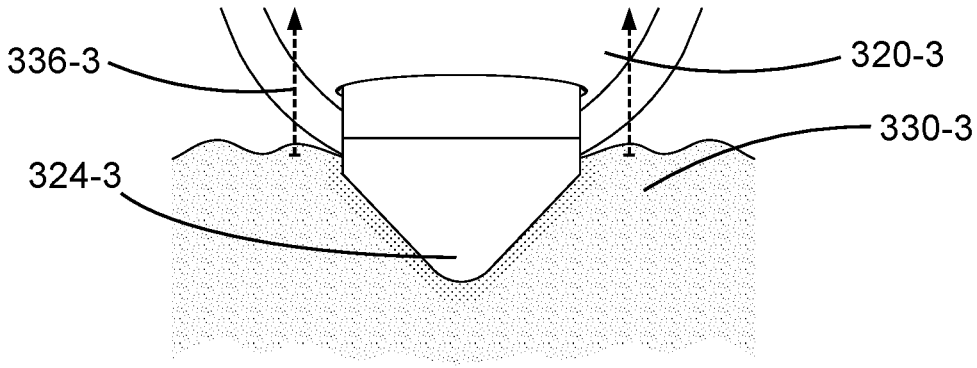

FIG. 3-1 shows an embodiment of an element 324-1 protruding from a working face 320-1 of a drill bit toward an internal surface 330-1 of a borehole. As shown in FIG. 3-2, such an element 324-2 may be urged to extend 335-2 from a working face 320-2 and crush, or otherwise displace, a portion 331-2 of an internal surface 330-2. It is believed that in many cases this crushing may increase, at least temporarily, a rate of penetration of a drill bit as it forms a borehole. In the embodiment shown, the element 324-2 extends by translating along a longitudinal axis thereof, although other motions are possible.

After extension, as a drill bit continues to drill, an extended element 324-3, as shown in FIG. 3-3, may be pushed to retract 336-3 back into a working face 320-3 of a drill bit by force from an internal surface 330-3. The rate of this retraction may be measured and, assuming the internal surface 330-3 is disposed at a terminus of the borehole, may indicate an instantaneous rate of penetration of the drill bit into the borehole.

Figures 1, 4:
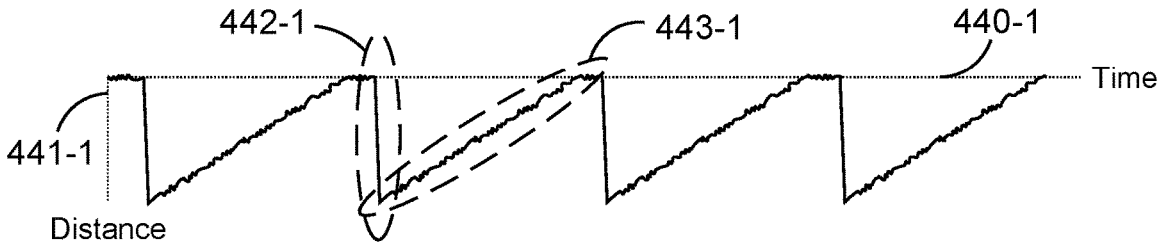
Figures 2, 4:
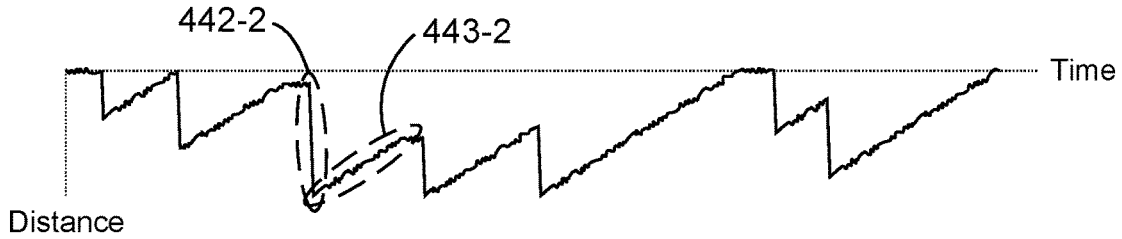
Figures 3, 4:
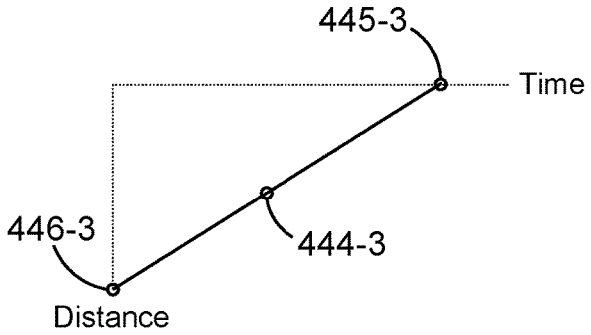
Figure 4:
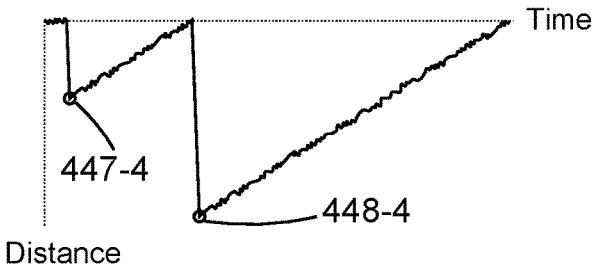

To continually measure a rate of penetration of a drill bit, the steps of urging extension and measuring retraction may be continuously repeated. FIG. 4-1 shows a chart representing an embodiment of this alternating, back-and-forth motion. Specifically, a horizontal axis 440-1 of the chart represents a passage of time and a vertical axis 441-1 represents a distance traveled by an extendable element. As can be seen, an element may extend 442-1 from a working face under a given force. In the embodiment shown, once a complete extension is reached the element may be allowed to retract 443-1 at a pace commensurate with progress of the drill bit through the earth. A slope of this retraction may represent an instantaneous rate of penetration of the drill bit. Once a specific retraction distance is achieved (back to a starting position in the present embodiment) the element may be extended again.

In other embodiments, an element may be extended from a drill bit for reasons in addition to the measurements described herein. For example, an element may be extended for such purposes as steering, preventing stick slip or motor stall, or crushing earthen materials. FIG. 4-2 shows a chart representing an embodiment of element displacement over time based on some purpose other than pure measurement. As such, the element may be extended 442-2 at diverse times and for varied distances. Regardless of extension timing however, a slope of a retraction 443-2 of the element may still indicate instantaneous rate of penetration as before.

Time spent urging extension may be assessed separately from time spent measuring retraction. If it is assumed that a drill bit is progressing at a similar rate of penetration during both extension and retraction, then a measured retraction rate may be extrapolated over any time spent extending to estimate a continuous rate of penetration. One embodiment of such estimation is represented in a chart in FIG. 4-3 where a slope 444-3 of a measured rate of retraction is projected over an entire time spent drilling 445-3. Such a chart may allow for approximating a depth 446-3 of a borehole if generally straight and vertical. In practice, as slight differences between measured and actual depth accumulate over time, this depth measurement may be reset with a more accurate reading when available. Additionally, while the embodiment shown assumes a similar rate of penetration during periods of both extension and retraction, other embodiments may account for changes in penetration rate due to urging forces during times of extension.

FIG. 4-4 shows another chart representing an additional embodiment of an element's displacement versus time. If, while urging an element to extend from a working face and engage a surface, a constant force is applied then a distance that the element extends into the surface may reveal some information about a material makeup of that surface. For example, as shown in FIG. 4-4, urging an element to extend under a certain force may allow the element to press into an earthen formation a first distance 447-4. Knowledge of this first distance 447-4 may provide some information about the material into which the element is being pressed. If a subsequent extension of the element under the same force presses it into the earthen formation a second distance 448-4, significantly different from the first distance 447-4, then a change in material properties of the earthen formation might be presumed.

Figures 4, 5:
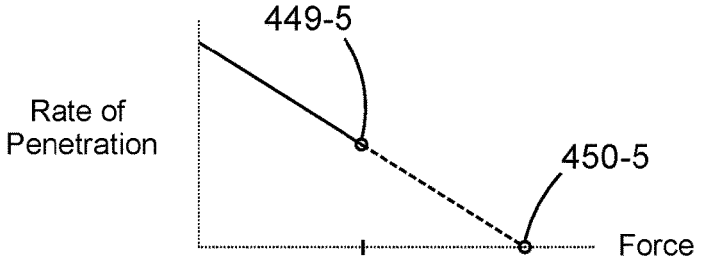
Figure 5:
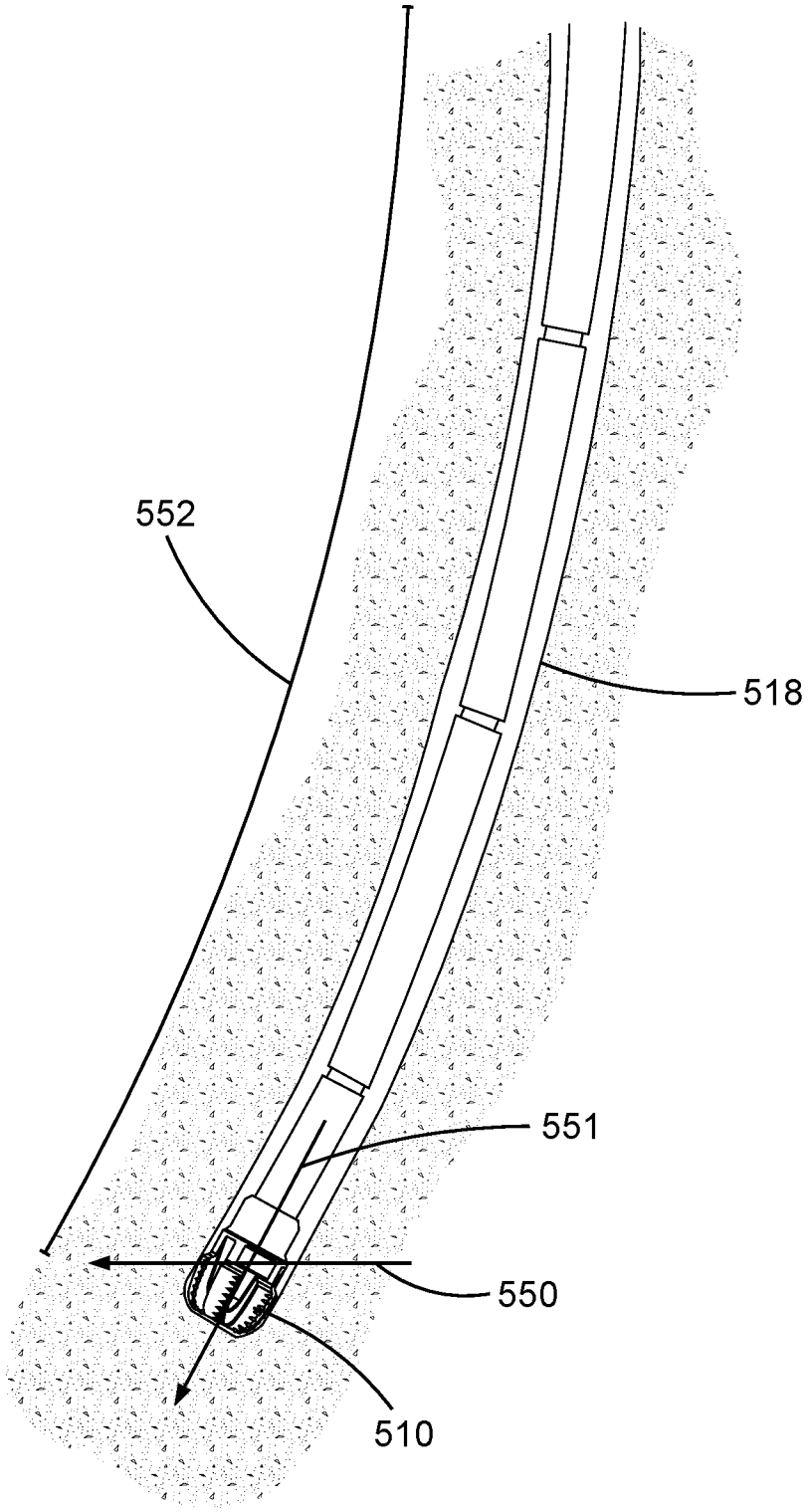

The force applied to an element, urging it to extend from a working face, need not remain constant as just described. Moreover, much may be learned by adjusting this applied force and monitoring the results. For example, FIG. 4-5 shows a chart representing an embodiment of a rate of penetration of a drill bit, while forming a borehole in an earthen formation, versus a force exerted on an element, urging it to extend from a working face of the drill bit. As the force applied to the element increases, the element may take on a larger percentage of a force seen by the drill bit from an internal surface of the borehole, known as weight-on-bit. As the element takes more of the weight-on-bit, less is experienced by cutting elements of the drill bit. This reduction in the amount of weight-on-bit sensed by the cutting elements may diminish engagement by the cutting elements, and thus reduce the rate of penetration of the drill bit in a fairly constant slope as can be seen in the chart.

At a certain point 449-5 the element may reach a limit as to how much of the weigh-on-bit it can take from the cutting elements. However, if the slope of the chart is extrapolated to meet the horizontal axis, a point 450-5 at which it crosses may represent a halting of drill bit penetration and a force equaling the entire weight-on-bit. Just as downhole rate of penetration data may be valuable to certain downhole tools, downhole weight-on-bit data may prove similarly valuable compared to surface produced estimates.

In addition to downhole rate of penetration and weight-on-bit measurements, calculations may be performed downhole resulting in further drilling parameters. For example, as shown in FIG. 5 which shows an embodiment of a drill bit 510 forming a borehole 518, an azimuth 550 and an inclination 551 of the drill bit 510 may be measured by any of a variety of known means. Between these azimuth 550 and inclination 551 measurements and the rate of penetration measurement described previously an estimate of a radius of curvature 552 being formed in the borehole 518 may be determined through calculation. This radius of curvature 552 may be important in determining depth of the drill bit 510, as differentiated from a length of the borehole. The measured radius of curvature 552 may also be compared to a target radius of curvature to aid in adjusting a steering process based thereon.

Whereas the discussion has revolved around the drawings attached hereto, it should be understood that other and further modifications apart from those shown or suggested herein, may be made within the scope and spirit of the present disclosure.

The invention claimed is:

1. A method for determining a rate of penetration of a downhole drilling operation, comprising:

urging an element to extend from a working face of a drill bit, wherein urging the element to extend is performed once a specific retraction displacement of the element is reached, and the element is free to rotate relative to the working face of the drill bit; and measuring a rate of retraction of the element into the working face due to force from an internal surface of a borehole.

2. The method of claim 1, further comprising repeatedly alternating between urging and measuring.

3. The method of claim 2, wherein urging the element to extend is performed at intervals selected to increase a rate of penetration of the drill bit.

4. The method of claim 2, further comprising detecting variation in a maximum extension of the element.

5. The method of claim 2, further comprising:

altering a force urging the element to extend;

comparing the measured rate of retraction during application of different urging forces; and projecting the compared measured rates to a point of zero rate to estimate a weight on bit.

6. The method of claim 1, wherein urging the element to extend displaces a portion of the internal surface.

7. The method of claim 6, wherein displacing the portion of the internal surface increases a rate of penetration of the drill bit.

8. The method of claim 6, wherein displacing the portion of the internal surface comprises crushing the portion.

9. The method of claim 1, further comprising independently measuring the time spent urging and measuring.

10. The method of claim 9, further comprising projecting the measured rate of retraction onto the time spent urging to estimate a rate of penetration of the drill bit.

11. The method of claim 10, further comprising estimating a depth of the drill bit based on the estimated rate of penetration.

12. The method of claim 10, wherein projecting the measured rate of retraction onto the time spent urging comprises accounting for a change in rate of penetration due to a force of the urging.

13. The method of claim 1, further comprising:

measuring an azimuth and inclination of the drill bit during the measuring of the rate of retraction; and estimating a radius of curvature traveled by the drill bit based on the measured azimuth, inclination and rate of retraction.

14. The method of claim 13, further comprising comparing the estimated radius of curvature to a target radius of curvature and adjusting a steering process based thereon.

15. The method of claim 1, wherein urging the element to extend comprises translating the element along a rotational axis of the working face.

16. The method of claim 15, wherein the element comprises an axially symmetrical geometry where it makes contact with the internal surface, and the element extends from the working face at the rotational axis of the drill bit.

17. A method for determining a rate of penetration of a downhole drilling operation, comprising:

urging an element to extend from a working face at a rotational axis of a drill bit;

measuring a rate of retraction of the element into the working face due to force from an internal surface of a borehole;

measuring an azimuth and inclination of the drill bit during the measuring of the rate of retraction; and estimating a radius of curvature traveled by the drill bit based on the measured azimuth, inclination and rate of retraction.

18. The method of claim 17, wherein urging the element to extend is performed once a specific retraction displacement of the element is reached.

19. A method for determining a rate of penetration of a downhole drilling operation, comprising:

urging an element to extend from a working face of a drill bit, wherein the element is free to rotate relative to the working face of the drill bit; and measuring a rate of retraction of the element into the working face due to force from an internal surface of a borehole.

* * * * *